US005123319A

United States Patent [19]

Reuter

[11] Patent Number: 5,123,319

[45] Date of Patent: Jun. 23, 1992

[54] CIRCULAR SAW

[75] Inventor: Alfred Reuter, Oberkirch, Fed. Rep. of Germany

[73] Assignee: Gebruder Linck Maschinenfabrik "Gatterlinck" GmbH & Co. KG, Oberkirch, Fed. Rep. of Germany

[21] Appl. No.: 455,352

[22] PCT Filed: Apr. 22, 1988

[86] PCT No.: PCT/EP88/00038

§ 371 Date: Nov. 6, 1989

§ 102(e) Date: Nov. 6, 1989

[87] PCT Pub. No.: WO88/08778

PCT Pub. Date: Nov. 17, 1988

[30] Foreign Application Priority Data

May 9, 1987 [DE] Fed. Rep. of Germany ..... 3715553
Sep. 9, 1987 [DE] Fed. Rep. of Germany ..... 3730154

[51] Int. Cl.[5] ..... B27B 25/02; B27B 25/06; B27B 5/34

[52] U.S. Cl. ..... 83/440; 83/430; 83/444; 83/446; 83/495; 144/178

[58] Field of Search ..... 83/440, 448, 449, 450, 83/495, 504, 441, 444, 446, 430, 114; 144/178, 39, 41, 378

[56] References Cited

U.S. PATENT DOCUMENTS

| | | | |
|---|---|---|---|
| 1,881,020 | 10/1932 | McFarland | 83/495 |
| 2,569,878 | 10/1951 | Avinger et al. . | |
| 3,347,289 | 10/1967 | Kotesovec et al. | 144/378 |
| 3,668,965 | 6/1972 | Kreuschmer | 83/114 |
| 4,572,256 | 2/1986 | Rautio . | |
| 4,691,749 | 9/1987 | Reuter | 83/504 |
| 4,711,279 | 12/1987 | Reuter . | |

FOREIGN PATENT DOCUMENTS

| | | | |
|---|---|---|---|
| 2918622 | 11/1980 | Fed. Rep. of Germany | 144/378 |
| 3103575 | 11/1981 | Fed. Rep. of Germany . | |
| 3415932 | 11/1985 | Fed. Rep. of Germany . | |
| 3644503 | 1/1988 | Fed. Rep. of Germany . | |

*Primary Examiner*—Douglas D. Watts
*Assistant Examiner*—Allan M. Schrock
*Attorney, Agent, or Firm*—Burns, Doane, Swecker & Mathis

[57] ABSTRACT

A circular saw shaft for cutting wood comprises a motor-driven shaft and a circular saw blade mounted on the shaft. A support disk is mounted on the shaft in spaced relationship to the saw blade to apply to the wood a supporting force in a direction extending parallel to the axis of rotation of the shaft. The support disk can be fixed to the shaft, or biased along the shaft axis by springs. In lieu of springs, the support disk could be elastically flexible.

15 Claims, 5 Drawing Sheets

CIRCULAR SAW

BACKGROUND OF THE INVENTION

The invention concerns circular saw for cutting wood such as tree trunks, blocks or squared wood with previously machined parallel side faces, with at least one circular saw blade mounted on a saw shaft.

Tree trunks, blocks or squared wood are cut by circular saw blades mounted on a saw shaft by longitudinal cuts into planks, boards or squared wood. The wood is guided by the associated transport and feeder mechanism and/or separate guiding element. The guiding accuracy affects not only the dimensional accuracy of the wooden work pieces produced, but also affects the potential lateral forces applied by the wood to the circular saw blades. The lower the lateral forces to be expected, the thinner the circular saw blades can be, which in turn leads to narrower saw gaps and thus to less loss of material due to sawing chips.

The guiding accuracy in the sawing zone decreases with the distance of the structural elements from the circular saws. It is therefore the object of the invention to design a circular saw of the aforementioned type so that the most accurate guidance of the wood in the sawing zone may be obtained with a low structural effort.

SUMMARY OF THE INVENTION

This object is attained according to the invention by that a supporting disk is mounted axially spaced apart from the circular saw blade on the saw shaft, said disk having a supporting surface on its frontal surface facing the circular saw blade, for the lateral surface of the three trunk, block or squared wood.

This supporting surface is located in the immediate vicinity of the circular saw blade and therefore provides a high guiding accuracy. The structural effort is low, because no separate guide element are needed, aside from the supporting disk. The axial forces acting on the supporting disk are absorbed directly by the saw shaft. The guidance of the wood becomes effective shortly after the onset of the saw cut and remains effective until after the cut is completed.

The supporting disks may be mounted fixedly on the saw shaft, so that they rotate at the rpm of the saw shaft. In order to further reduce the friction generated between the supporting surface and the wood, in a further development of the concept of the invention the support disks may be supported in a freely rotating manner on the shaft by means of a support bearing. The support disks then move with a peripheral velocity corresponding to the rate of advance of the wood, so that frictional forces will be at a minimum.

According to a particularly advantageous form of embodiment of the invention the support disk possesses a support ring axially protruding toward the wood surface to be supported, with the diameter of said support ring being approximately equal to the external diameter of the circular saw blade. The lateral support force is then applied to the wood adjacent the region cut by the saw teeth, i.e. at the location at which the side board being cut is still connected with the main piece of the wood. As preferably identical support disks are mounted on opposing sides of the tree trunk, the trunk is supported and guided at the location at which the saw cuts begin. In this manner relatively high lateral forces may be applied from both sides, without the risk of compressing an already existing saw gap between the boards, planks or squared woods.

According to the invention two opposing support disks may be mounted either on a common saw shaft on either side of the circular saw blade or a group of saw blades located adjacent to and spaced apart from each other, or a support disk each may be mounted on the hub of opposing circular saw heads.

A particularly advantageous form of embodiment of the invention consists of the support disk carrying the support ring is in the form of a thin disk axially deformable in an elastic manner. This elastic support disk is able to deflect laterally by a certain amount, in order to equalize dimensional differences of the width of the trunk and/or to facilitate the entry of the trunk between opposing support disks. In this fashion, the requirements relative to the processing accuracy of the tree trunk and the guiding accuracy of the installations feeding the trunk to the saw, may be reduced. In addition, excessive stressing of the support disk by the impact of the entry of the trunk is avoided.

THE DRAWINGS

The invention will become more apparent from the following examples of embodiment with reference to the drawing, in which:

FIG. 1 shows a section of a saw shaft of a circular saw for the cutting of tree trunks, blocks or squared wood, with support disks mounted fixedly on the saw shaft, FIG. 2 in a partial section similar to that of FIG. 1 a circular saw with support disk mounted in a freely rotating manner on the circular saw shaft, FIG. 3 in a view similar to that of FIG. 2, a modified form of embodiment with support disks with a support ring protruding toward the trunk, FIG. 4 in a partial section similar to FIG. 3, a form of embodiment with axially displaceable circular saws and support disks, FIG. 5 a view at a reduced scale of the layout of FIG. 4, FIG. 6 in a section, a circular saw head with a support disk mounted rotatingly on the hub, FIG. 7 a section corresponding to FIG. 4 with a spring action support disk.

DETAILED DESCRIPTION OF PREFERRED EMBODIMENTS OF THE INVENTION

Figure 1:
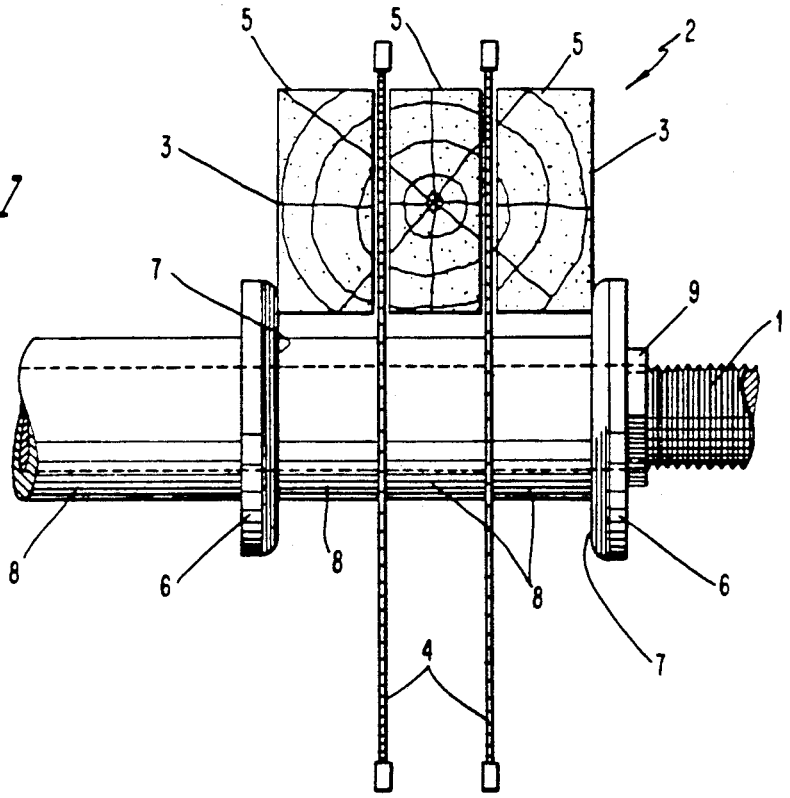

The saw shaft 1 shown in FIG. 1 for example as a continuous shaft, whereby trunks, blocks or squared wood provided with routed edges cut by longitudinal section into planks, boards or squared wood. The wood is fed to the circular saw by a feeder installation,for example a driven chain bed. In many cases the wood 1 to be cut already has worked lateral surfaces 3, for example surfaces produced by contour cutting or sawn surface following the cutting of side goods, or routed edges.

On the saw shaft 1, two circular saw blades 4 are mounted parallel and spaced apart. Each saw blade 4 passes completely through the wood in a direction extending transversely of the axis of rotation of the shaft 1 and transversely of the direction of travel of the wood whereby the squared wood introduced is cut into three planks or squared woods 5.

Laterally spaced apart from the two circular saw blades 4, support disks 6 are mounted on and rotating with the saw shaft 1, with the frontal side facing the adjacent saw blade of said support disk forming a support surface 7. The processed lateral surfaces 3 of the wood 2 are abutting against the support surfaces 7. The support surface thus support and guide the wood in the cutting zone.

Between each support disk 6 and the adjacent circular saw blade 4 and between the two circular saw blades 4 a replaceable spacing sleeve 8 is located on the saw shaft 1. The structural group consisting of the circular saw blades 4, the spacing sleeves 8 and the support disks 6 is secured on the saw shaft 1 by means of a clamping nut 9. The torque is transmitted by a feather key (not shown).

Figure 2:
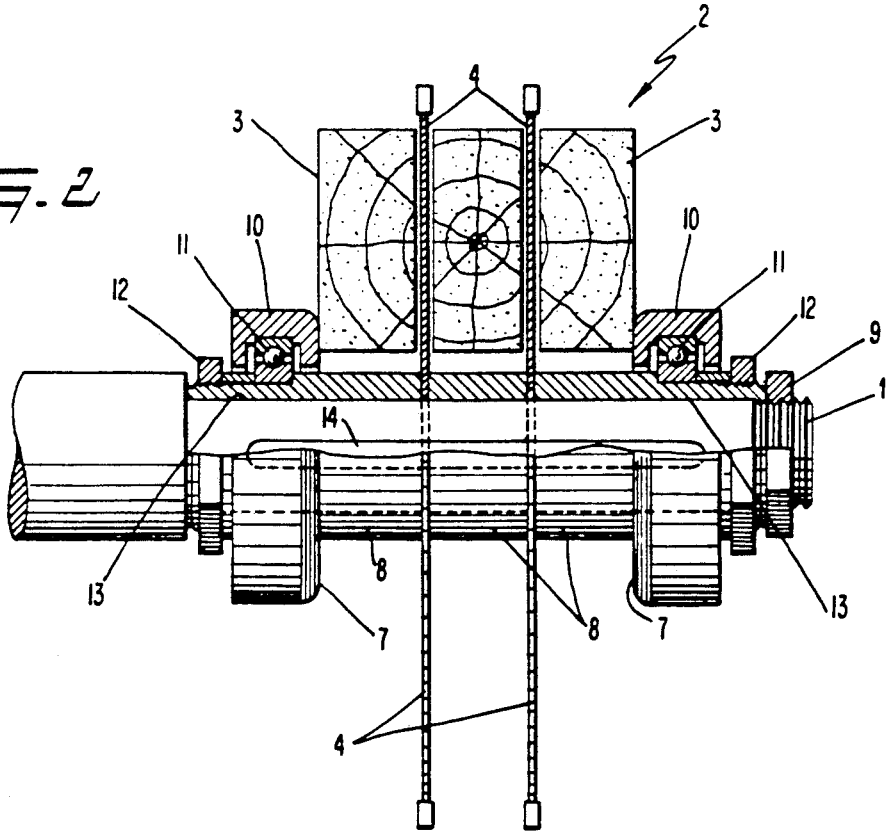

The example of embodiment shown in FIG. 2 differs from the example of FIG. 1 in that the supporting surfaces 7 supporting and guiding the cut side surfaces 3 of the wood 2 are provided on freely rotating annular support disks 16.

The two support disks 16 are freely rotating on the saw shaft 1 supported on roller bearings, for example a deep groove ball bearing. The inner ring of each of the support bearings 11 is mounted by means of a tensioning nut 12 on an inner bearing sleeve 13, which is located in a replaceable manner on the saw shaft 1 and is not rotating.

By means of the tensioning nut 9 the inner bearing sleeves 13, the circular saw blades 4 and the spacing sleeves 8 placed in between are fastened replaceably on the saw shaft 1. A feather key 14 establishes the nonrotating connection between these structural parts and the saw shaft 1.

While the saw shaft 1 in the example shown in FIG. 1 is a continuous shaft with bearings (not shown) located on either side of the circular saw, in FIG. 2 the end of a flying saw shaft 1 is illustrated.

Figure 3:
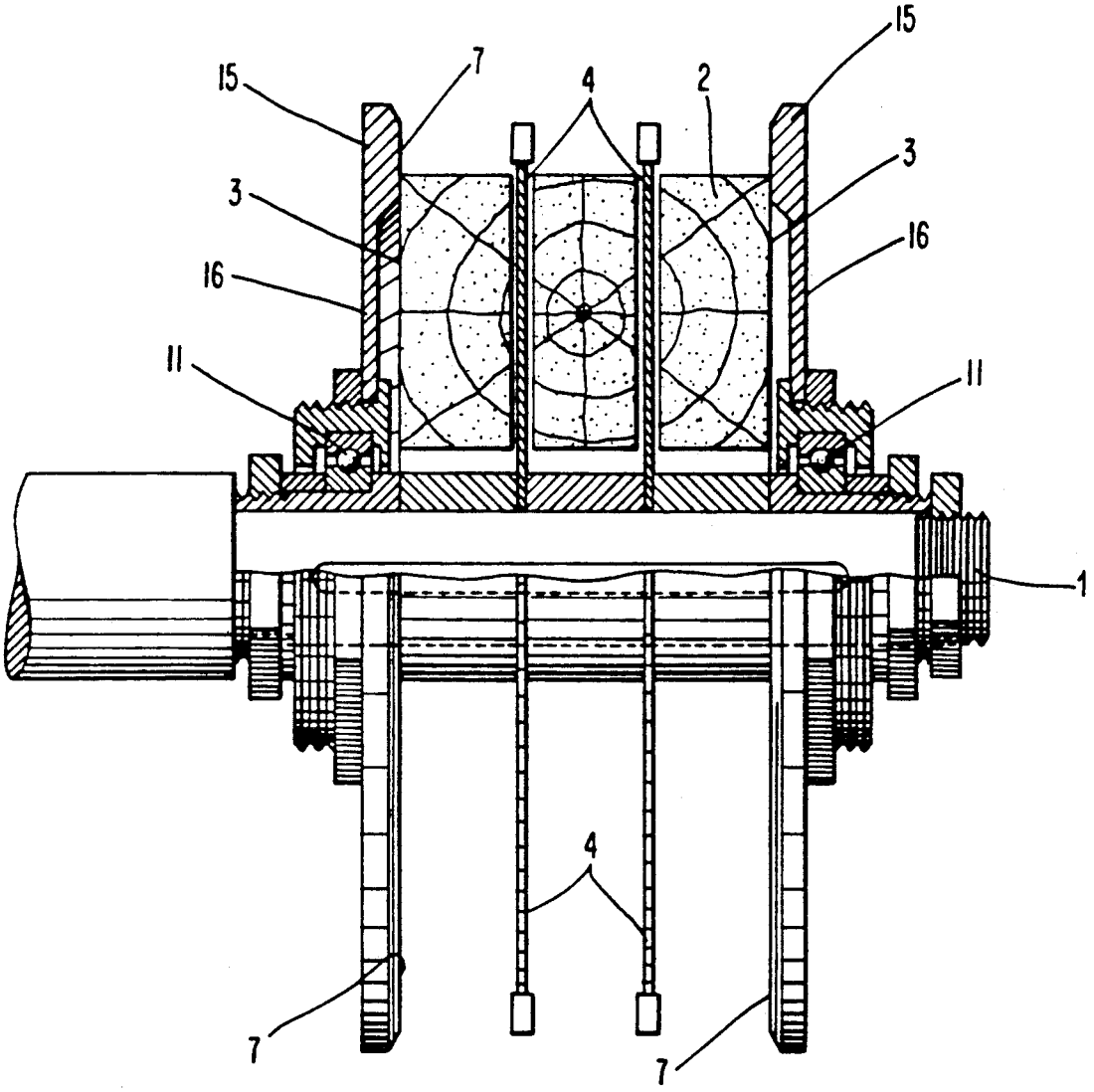

The form of embodiment according to FIG. 3 differs from that of FIG. 2 only in that the support surfaces 7 supporting and guiding the cut lateral surfaces 3 of the wood 2 are formed on support rings 15 and project from a relatively narrow support disk 16, axially relative to the wood surface 3 to be supported. The diameter of the support 15 is approximately equal to the diameter of the saw blades 4. The wood 2 is therefore supported by the two opposing support rings 15 approximately in the area in which the cuts produced by the circular saw blades 4 begin. As in the example of FIG. 2, the support disks 16 are freely rotating on the saw shaft 1.

Figure 4:
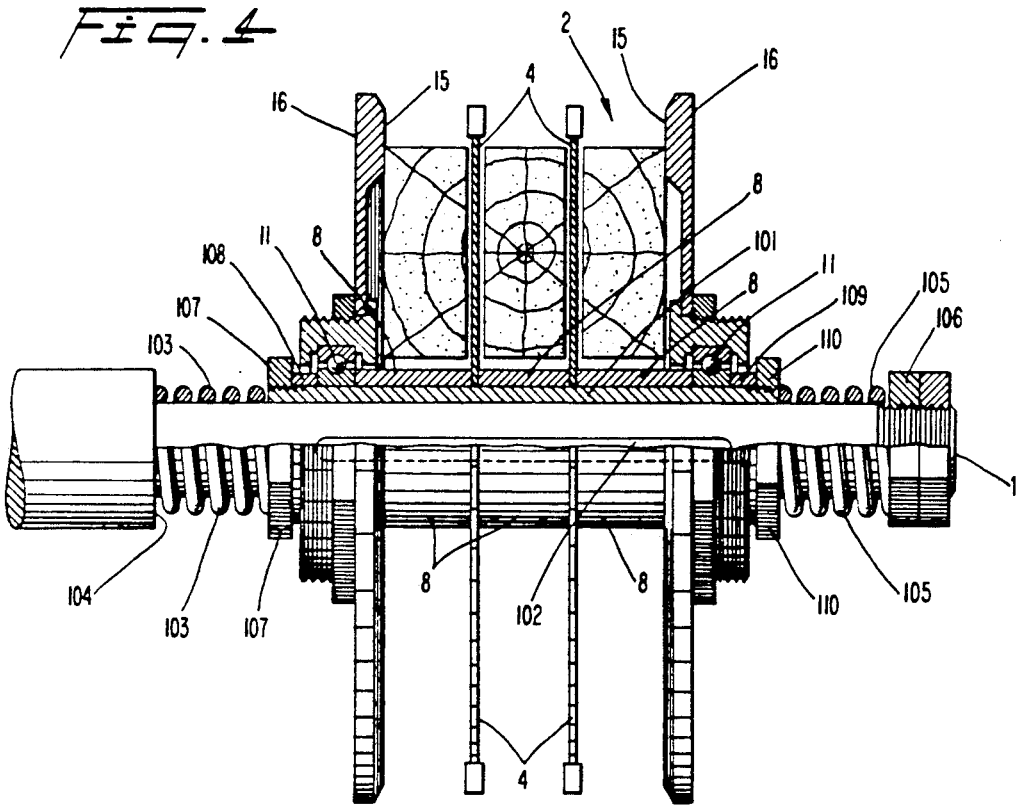

The form shown in FIG. 4 differs from that of FIG. 3 only by that an axially displaceable support sleeve 101 is provided on the saw shaft 1, driven in rotation by a feather key 102 located on the shaft 1. The support sleeve 101 is resting at one of its ends by means of a compression spring 103 on a shoulder 104 of the saw shaft 1. At its other end, the support sleeve 101 is supported axially by means of a compression spring 105 on nuts 106 mounted on the saw shaft 1.

A nut 107 is screwed onto one end of the support sleeve 101, the inner bearing ring of one of the support bearings being supported by means of an intermediate ring 108 against said nut 107. On the other side of the bearing 11, the spacing sleeves 8 and the saw blades 4 are located alternatingly. In a similar manner, the other end is followed by the other support bearing 11, which is again being held in place through an intermediate ring 109 by a nut 110, which is tightened against the nut 107 on the other end of the support sleeve 101.

The entire structural unit carried by the support sleeve 101 may be displaced against the force of the compression springs 103 and 105 axially on the saw shaft 1. The circular saw blades 4 and the support disks 16 are therefore able to move axially, as soon as the wood 2 enters between the support rings 15 of the disks 16. In contrast to the aforedescribed centering of the wood 2 between the disks 16, here the disks 16 and the saw blades 4 located between them are centered relative to the wood 2, which does not change its lateral position.

Figure 5:
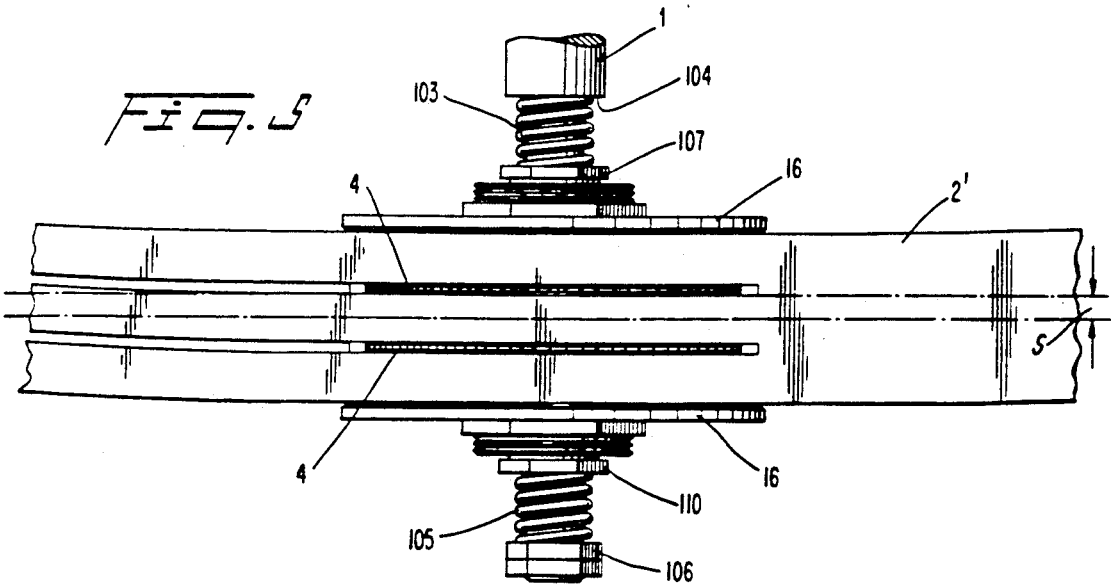

FIG. 5 shows the feeding of a curved wood trunk or squared wood 2' to a circular saw layout according to FIG. 4. Due to the curvature of the wood 2', the support sleeve 101, together with the saw blades 4 and the support disks 10 located on it, is displaced laterally by the distance S shown in FIG. 5. The support disks 16 and thus the saw blades 4 follow the curving shape of the wood 2' and cut in spite of the guidance of the wood on a straight line, planks or beams of uniform thickness. The wood 2' may be fed in a straight line for example by means of chain beds, onto which the wood is pressured in a laterally unmovable manner.

In the example according to FIGS. 4 and 5 the external diameter of the support rings 15 is slightly larger than the outer diameter of the saw blades 4. In this manner, the lateral centering of the support disks 16 relative to 2 or 2' takes place immediately prior to the action of the saw blades 4.

If a larger lateral deviation is to be expected even at the onset, the conical surface on the outer edge of the protective ring 15 is conveniently chosen larger than in FIG. 4.

The use of the circular saw is described in FIGS. 1-5 by the examples of squared wood 2, but blocks having cut lateral surfaces at least on two sides or round trunks into which two longitudinal edges had been milled, said edges forming cut lateral surfaces, may also be processed.

The two circular saw heads 17 and 17' are used to cut two side boards 19 and 20 from a trunk 18 on two opposing sides. The trunk had been flattened previously for example on two opposing sides or on all four sides and between two adjacent lateral surfaces two edges 21 were milled out. On the side of the trunk 18 opposite the two saw heads 17 and 17', two corresponding circular saw heads are again located over each other and offset in the longitudinal direction of the trunk 18.

Each circular saw head 17 and 17' carries on a saw shaft 1 two adjacent, spaced apart circular saw blades 22 and 23 of the same diameter. The two saw blades 22 and 23 are annular or in the form of a circular segment and fastened to a carrier disk 24 and 25, which together are mounted on a hub ring 26. The hub ring 26 is a part of a hub 27 fastened on the shaft. Each of the shafts 1 has a supported end connected to the motor and extends therefrom to a shaft free end. The blades 22, 23 define remote and proximate saw blades, respectively, with respect to their proximity to the motor-supported end of the shaft. The same is true of the blades 22A, 23A of the other saw head 17'. The remote blades 22, 22A rotate in a common remote plane RP, whereas the proximate blades 23, 23A rotate in a common proximate plane PP.

On the hub 27 or the hub ring 26, by means of a support bearing 28, for example a deep grove ball bearing, a support disk 29 is mounted in a freely rotating manner, with the support ring 15 projecting axially from the periphery of said support disk, as described above. As in the example of FIG. 3, the outer and the inner edges 30 and 31 of the support ring 15 are bevelled, to facilitate the introduction of the wood between the support rings 15.

The support disk 29 is disposed between the proximate plane PP and the motor-supported end of the shaft 1.

The supporting surface 7 facing the trunk 18, the diameter of which is approximately equal to the outer diameter of the saw blades 22 and 23, supports both the trunk 18 in the area of the onset of the saw blades 22 and 23, and the outer side of the outer side board 19.

Figure 6:
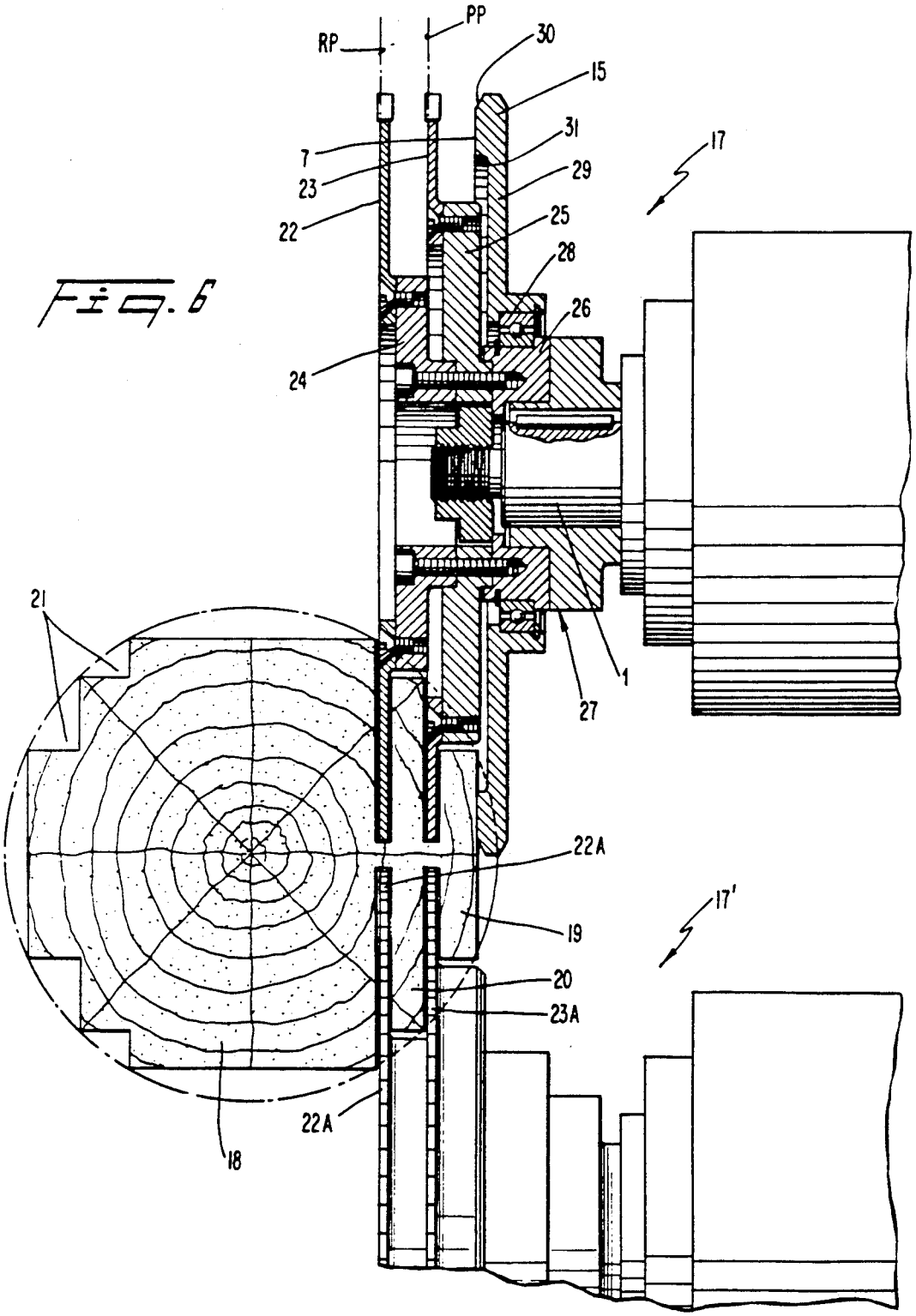
Figure 7:
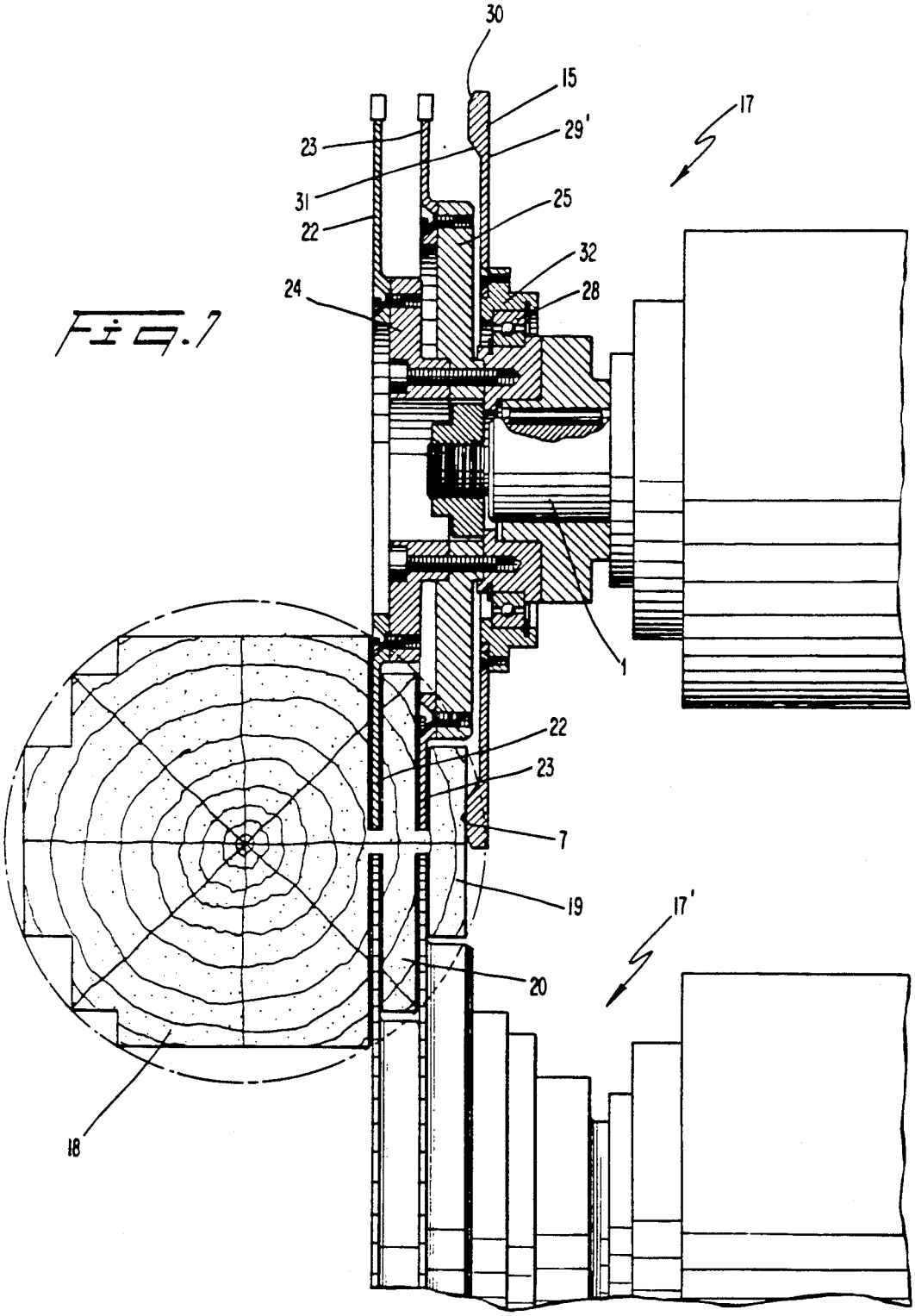

The example of FIG. 7 differs from that of FIG. 6 only in that the support disk 29' carrying the support ring 15 is in the form of a very thin disk with a spring elastic movement in the axial direction, similar to a circular saw blade. The support disk 29' has an inner fastening ring 32, seated on the outer ring of the supporting bearing 28.

It is obtained by the spring elastic mounting of the support ring 15 and the bevelling of the outer edge 30 and the inner edge 31, that even trunks coming in with dimensional deviations relative to their width and/or with a certain lateral offset between the opposing support rings, are centered. This centering of the tree trunk takes place simultaneously with the onset of the sawing cut of the saw blades 22 and 23. As the saw teeth have cutting edges on their two sides also, a slight lateral displacement of the trunk under the guidance of the support rings 15 is still possible immediately following the beginning of the saw cut, without the application of unacceptably high lateral forces to the saw blades 22 and 23.

This effect is also obtained in the case of rigid support disks 29 (FIG. 6); the elasticity in the axial direction of the support disk 29' (FIG. 7) reduces lateral impacts during the entry of a trunk 10 not centered exactly in the lateral direction and permits dimensional deviations in width.

The support disks 29 and 29' shown in FIGS. 6 and 7 at the upper circular saw head only, may also be provided in a similar manner at the lower saw head 17' also. However, as shown in the case of one of the saw heads 17 and 17', the support disk 29 or 29' may be eliminated.

In either event, and as is evident from each of FIGS. 6 and 7, neither of the saw heads 17, 17' carries more than one support disk.

I claim:

1. A circular saw for cutting wood, comprising:

a motor-driven saw shaft rotatably driven about an axis of rotation, a circular saw blade mounted on said saw shaft for rotation therewith to cut the wood in response to relative movement between the wood and saw blade in a first direction oriented transversely of said axis of rotation, and a support disk mounted coaxially on said shaft in spaced relationship to said saw blade, said support disk including support surface means facing said saw blade for applying to the wood a supporting force in a second direction extending towards said saw blade and transversely of said first direction.

2. A circular saw according to claim 1, wherein said saw blade is arranged and dimensioned to cut completely through the wood in a third direction extending transversely of both of said first and second directions.

3. A circular saw according to claim 1, wherein said support disk is fixedly secured to said saw shaft.

4. A circular saw according to claim 1 including bearing means mounting said support disk on said shaft for rotation relative thereto.

5. A circular saw according to claim 4 including sleeve means fixedly mounted on said shaft, said bearing means mounted on said sleeve means.

6. A circular saw according to claim 1, wherein said support disk has an outer diameter generally equal to an outer diameter of said saw blade.

7. A circular saw according to claim 6, wherein said support surface is disposed adjacent a radially outer periphery of said support disk and extends closer to said saw blade than a portion of said support disk situated radially inwardly of said support surface.

8. A circular saw according to claim 6, wherein said support disk includes beveled portions extending from radially outer and inner ends of said support surface.

9. A circular saw according to claim 6 including spring means yieldably biasing said support disk in a direction toward said saw blade.

10. A circular saw according to claim 6, wherein said support disk includes a thin ring carrying said support surface, said ring being elastically deformable in a direction transversely of both said first and second directions.

11. A circular saw according to claim 1 including a second support disk spaced from said saw blade on a side thereof opposite said first-named support disk.

12. A circular saw according to claim 11 including a second saw blade disposed between said first-named saw blade and said second support disk.

13. A circular saw according to claim 11 including a sleeve mounted on said shaft for rotation therewith while being axially displaceable relative to said shaft, said circular saw blades being mounted on said sleeve for rotation therewith, said support disks mounted on said sleeve for rotation relative thereto.

14. A circular saw according to claim 13 including spring means biasing said sleeve in opposing axial directions.

15. A circular saw according to claim 1, wherein a second circular saw blade is mounted on said saw shaft in spaced relationship to said first-named saw blade; a second motor driven shaft being rotatably driven about a second axis of rotation oriented parallel to said first-named axis of rotation; third and fourth circular saw blades being mounted on said second shaft in spaced-apart relationship; said first-named shaft and said second shaft each including a shaft supported end and extending therefrom to a shaft free end; said first-named shaft and said second shaft each being driven at its supported end; said first-named saw blade and said third saw blade defining proximate saw blades lying closer to said support ends than said second and fourth saw blades which define remote saw blades; said remote saw blades being rotatable in a common remote plane, said proximate saw blades being rotatable in a common proximate plane; said remote and proximate saw blades being operable to cut lateral boards from the wood; and a support disk mounted on at least one of said first-named shaft and said second shaft at a location between said proximate plane and said shaft supported ends; said support disk including support surface means facing said proximate plane for applying to the wood a supporting force extending transversely of said proximate plane; neither of said first-named and second shafts carrying more than one said support disk.

* * * * *